United States Patent [19]

Vecchiarelli

[11] 4,265,423

[45] May 5, 1981

[54] SUPPORT BRACKET FOR A VENETIAN BLIND HEAD RAIL

[75] Inventor: Francis Vecchiarelli, River Edge, N.J.

[73] Assignee: Hunter Douglas International N.V., Curaco, Netherlands

[21] Appl. No.: 43,697

[22] Filed: May 30, 1979

[51] Int. Cl.[3] ..... A47M 1/10

[52] U.S. Cl. ..... 248/264; 160/178 B

[58] Field of Search ..... 248/261, 262, 263, 264, 248/265, 252, 254, 257, 258, 259; 160/178 B

[56] References Cited

U.S. PATENT DOCUMENTS

| | | | |
|---|---|---|---|
| 2,255,326 | 9/1941 | Mintz | 248/264 |
| 2,526,393 | 10/1950 | Nelson | 160/178 B UX |
| 2,670,167 | 2/1954 | Nelson | 248/264 |
| 2,680,589 | 6/1954 | Nelson | 248/264 |
| 2,792,999 | 5/1957 | Lorentzen | 248/264 |
| 2,916,246 | 12/1959 | Radel | 248/264 |
| 4,071,215 | 1/1978 | Marotto | 248/264 X |
| 4,177,853 | 12/1979 | Anderson et al. | 160/168 R |

*Primary Examiner*—J. Franklin Foss

*Attorney, Agent, or Firm*—Pennie & Edmonds

[57] ABSTRACT

A support bracket for a venetian blind headrail which is in the form of an open sided box structure including a side wall, with a top wall and a bottom wall connected to the side wall, a front wall having rearwardly extending top and bottom flanges connected to a forward portion of the top and bottom wall, respectively, by a vertical axis pivotal connection adjacent the side wall, a latch provided between the top and bottom flanges and the top and bottom walls, the latch locking the front wall in position when the front wall is moved sideways towards the side wall.

7 Claims, 6 Drawing Figures

SUPPORT BRACKET FOR A VENETIAN BLIND HEAD RAIL

BACKGROUND OF THE INVENTION

The present invention relates to a support bracket for a Venetian blind head rail. Various forms of support bracket for this purpose have been proposed see, for example, U.S. Pat. Nos. 2,680,589, 2,267,160 and 2,200,510. These structures all involve the use of an open sided box structure which has a side wall, a rear wall and both top and bottom walls. The side opposite to the side wall is left open in the direction of the center of the headrail to be fitted to the bracket. One of the side wall and rear wall can be fitted to a wall surface and/or the top wall can be secured to a ceiling surface.

A front wall of the bracket is pivotally mounted to the side wall so that it can be pivoted either up or down to open up the front face of the box structure, to enable the ends of a head rail to slide in during the fitting of the head rail to the bracket.

The structures of U.S. Pat. Nos. 28,680,589 and 2,200,510 both have a rearwardly extending element which engages the bottom wall to lock the front wall. However, this rearwardly extending element, when the wall is pivoted up, forms and obstruction making it difficult to slide the head rail into place. Similarly, in U.S. Pat. No. 2,267,160, where the front wall pivots downwardly, the front wall itself forms an obstruction to raising the headrail before putting it in position.

It is an object of the present invention to overcome the above disadvantages.

SUMMARY OF THE INVENTION

It is now proposed, according to the present invention, to provide a support bracket for a venetian blind headrail in the form of an open sided box structure comprising, in combination:

(a) a side wall;

(b) a top wall connected to the side wall;

(c) a bottom wall connected to the side wall;

(d) a front wall having rearwardly extending top and bottom flanges;

(e) a vertical pivotal connection between the top and bottom flanges and the top and bottom walls, respectively, said pivotal connection being adjacent said side wall; and (f) latch means on at least one of said top and bottom walls and said top and bottom flanges, respectively, said latch means being spaced from said side wall, effective to prevent pivoting of said front wall away from the closed position of the bracket.

Since the front wall is mounted with a vertical axis and by means of top and bottom flanges of the front wall, the front wall can be pivoted out of the way completely so that there is no obstruction to the associated end of the venetian blind being introduced into the support bracket.

While the support bracket of the present invention can consist solely of the side wall and top and bottom walls with the front wall connected thereto, in order to rigidify the structure more, a rear wall is preferably connected to the top, bottom and side walls.

The pivotal connection between the front wall and the top and bottom walls preferably comprises an elongate slot formed in one of the top wall and top flange and bottom wall and bottom flange and a hinge element in the other of said members engage in each said slot, said slot having an axis extending perpendicular to said side wall, and wherein said latch member is formed on one of said top and bottom walls and/or in one of said top and bottom flanges, respectively, said latch member including the locking surface extending substantially perpendicular to said side wall and an aperture in the other of said members in which said latch member in the closed position of the bracket is lockingly engaged, and can be disengaged by displacing the front wall perpendicular to and away from the side wall.

Such an arrangement is relatively simple to manufacture and is particularly effective in locking the front wall in position when the head rail has been put in place. By having the locking surface extending substantially perpendicular to the side walls, and by having the effective lost motion connection provided by the elongated slot, which is elongate in the same direction as the locking surface, the latter can engage the aperture by sliding over the end of the top or bottom wall remote from the side wall and can readily prevent the pivoting motion.

Advantageously the pivoting can be further prevented by the rear surface of the front wall abutting the front surface of the side wall when the latch member is lockingly engaged in the aperture.

In a convenient structure, the hinge element is in the form of a lug bent out of the associated member.

In order to improve the locking effect, and increase the lever arm, the latch member is preferably adjacent the other side of the front wall from the hinge element.

In order further to rigidify the structure, when the front wall is in its locked position, the top flange of the front wall preferably extends over the forward portion of the top wall and the bottom flange of the front wall extends below the forward portion of the bottom wall, the top wall being offset downwardly, in its forward portion, to accommodate the top flange on or below the level of the upper surface of the remainder of the top wall.

In order that the present invention may more readily be understood, the following description of a presently preferred mode of putting the invention into effect is described, merely by way of example, reference being made to the accompanying drawing.

DETAILED DESCRIPTION OF THE PREFERRED EMBODIMENT

Figure 1:
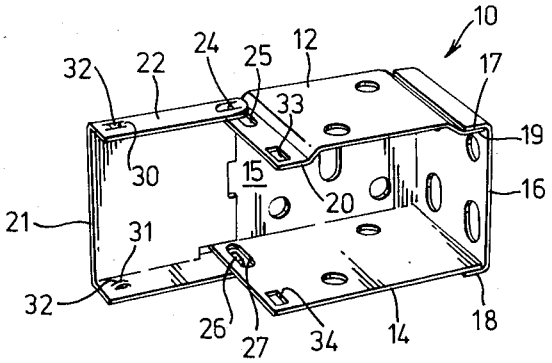
FIG. 1 is a perspective view of a preferred embodiment of support bracket for a venetian blind according to the invention, with the front wall shown pivoted open.

The bracket indicated by the general reference numeral 10 in FIG. 1 comprises a top wall 12, a bottom wall 14 and a side wall 15 connected to one another. A rear wall 16 is provided with a forwardly extending top flange portion 17 and bottom flange portion 18, the top flange portion fitting over a downwardly offset rearward portion 19 of the top wall.

Figure 3:
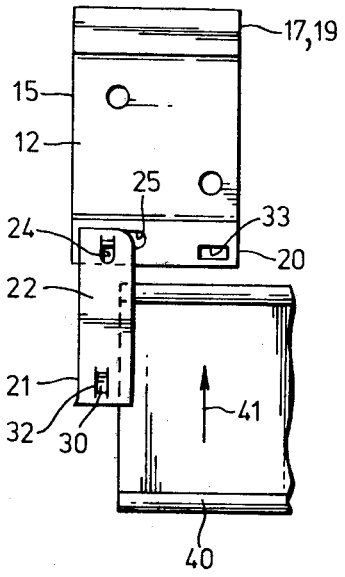
FIGS. 3, 4 and 5 are top plan views illustrating the insertion of the end of a venetian blind headrail into the bracket illustrated in FIG. 1.

The forward portion of the top wall is also offset downwardly. Pivotally connected to the top and bottom walls is a front wall 21 having a rearwardly extending top flange 22 and bottom flange 23. The pivotal connection is provided by a bent down lug 24 in the top flange engaging in a slot 25 in the forward portion 20 of the top wall, and by an upwardly bent lug 26 in the bottom flange engaging in a slot 27 in the bottom wall. As can be seen more clearly in FIGS. 3 and 4, the slot 25 is elongate, that is to say it has its major axis extending generally perpendicular to the side wall 15. The lugs 24 and 26 are aligned with one another and provide a vertical axis pivot for the front wall.

In order to lock the front wall in place, the top and bottom flanges 22 and 23 are provided, at a location adjacent the end of the front wall opposite that to which the lugs 24 and 26 are located, with latch members 30 and 31 which have curved lower and upper surfaces, respectively, and locking surfaces 32 which are parallel to the axes of the slots 25 and 27. Cooperating slots 33 and 34 are provided in the top, and bottom walls respectively.

Figure 2:
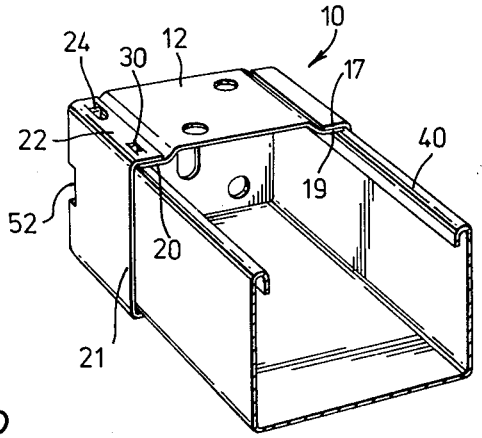
FIG. 2 is a perspective view of the bracket of FIG. 1, with a venetian blind headrail fitted thereinto.

In use, the bracket 10 is secured to the wall or ceiling surface by passing a screw or the like through one or more of the apertures formed in the top, rear or side walls. The front wall is pivoted to the open position illustrated in FIG. 1 and the headrail 40 (FIGS. 2 and 3) is slid rearwardly in the direction indicated by the arrow 41 in FIG. 3. The shape of the front wall and the vertical axis of the pivotal connection between the front wall and the top and bottom walls enables this movement of the headrail to take place readily.

Figure 4:
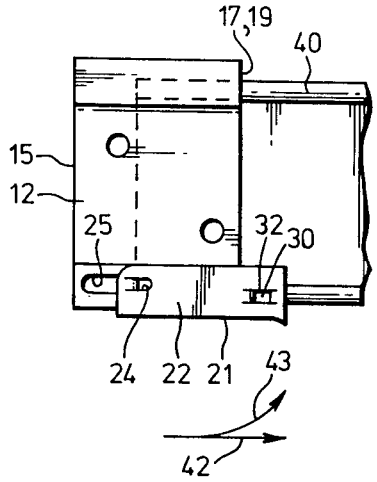

When the headrail is in position, as illustrated in FIG. 4, the front wall 21 is pivoted to the position illustrated in FIG. 4 having been moved slightly to the right as indicated by the arrow 42 before pivoting as shown by arrow 43. This enables the lugs 30 and 31 to be to the right of the top and bottom walls respectively.

Figure 5:
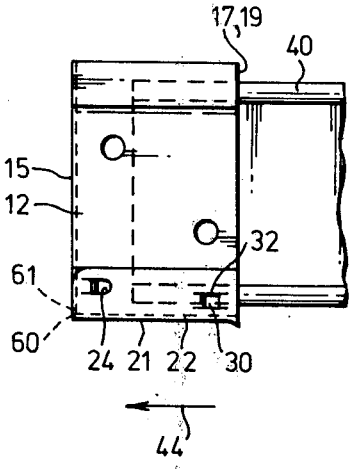

Thereafter the front wall is moved to the left as illustrated by the arrow 44 in FIG. 5 so that the latch members 30 to 31 engage in the apertures 33 and 34, respectively, to prevent pivotal movement of the front wall away from this locked position. In order further to enhance the locking, the lefthand portion, as illustrated in FIG. 5, of the rear surface 60 of the front wall 21 abuts the front surface 61 of the side wall 15 (as shown in phantom in FIG. 5) so that pivoting cannot take place.

The sliding indicated by arrow 44 during the locking motion is possible due to the provision of the elongate slot 25. The front or locking surfaces 32 of the latch members 30 and 31 being perpendicular to the side wall, and therefore perpendicular to the rotational movement of unlatching, serve to prevent any such unlatching taking place.

The offsetting downwardly of the front portion 20 enables the top flange 22 to be accommodated below the level of the upper surface of the remainder of the top wall, so that, when the top wall is secured to, or adjacent to a ceiling surface, movement of the front wall to the closed position is not precluded. It will be appreciated that the arrangement in which the flange 22 goes over the forward portion of the top wall and the flange 23 under the forward portion of the bottom wall assists in strengthening the bracket against any downward movement caused by the weight of the blind erected on the bracket through the headrail.

Figure 6:
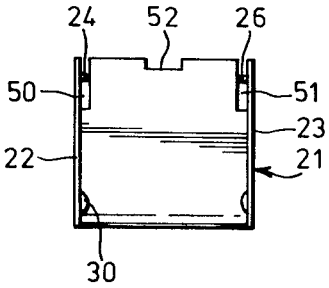
FIG. 6 is an elevation of the inside of the front wall removed from the bracket.

As can be seen in FIG. 6, the front wall 21 is provided, adjacent the top and bottom flanges 22 and 23, and at the ends in which the pivot tabs 24 and 26 are located, with cutaway portions 50 and 51. These portions accommodate the front portions of the top and bottom walls 12 and 14, respectively, during the pivoting of the front wall.

The front wall is also provided with a recess 52 which can be used when it is desired to unlatch the front wall, by inserting a screw driver or similar implement into the recess and levering against the side wall 15.

While the latch members have a rear surface which is parallel to the surfaces 32, so that the front wall can only be engaged in its locked position by being moved in the direction of the arrow 44, this is not essential. The back surface of the latch members can be inclined or curved, so that the front wall can be locked by moving it a short distance to the right so that the rear surface 60 of the front wall 21 is clear of the front surface 61 of the side wall, whereupon the front wall can be closed simply by pivoting it rearwardly.

I claim:

1. A support bracket for a venetian blind headrail in the form of an open sided box structure comprising, in combination:

(a) a side wall;

(b) a top wall connected to the side wall;

(c) a bottom wall connected to the side wall;

(d) a front wall having rearwardly extending top and bottom flanges running over substantially the complete width thereof;

(e) a vertical pivotal connection disposed adjacent said side wall between the top and bottom flanges and the top and bottom walls, respectively, said pivotal connection including (1) an elongate slot formed in one of said top wall and top flange and bottom wall and bottom flange, and (2) a hinge element in the other of said members engaged in each said slot, said slot having an axis extending substantially perpendicular to said side wall; and (f) latch means including (1) a locking surface extending substantially perpendicular to said side wall, and (2) an aperture into which said locking surface is lockingly engaged in the closed position of the bracket, and from which said locking surface is disengaged by displacing the front wall perpendicular to and away from the side wall, said locking surface disposed on at least one of said top and bottom walls or said top and bottom flanges and said aperture on the other, said latch means being spaced from said side wall and effective to prevent pivoting of said front wall away from the closed position of the bracket.

2. A support bracket as claimed in claim 1, wherein the rear surface of the front wall abuts the front surface of the side wall when the latch means is lockingly engaged in the aperture.

3. A support bracket as claimed in claim 1, wherein the hinge element is in the form of a lug bent out at the associated member.

4. A support bracket as claimed in claim 1, wherein the latch means is adjacent the other side of the front wall from the hinge element.

5. A support bracket as claimed in claim 1, wherein the latch means is forwardly offset with respect to the hinge element, in the closed position of the bracket.

6. A support bracket for a venetian blind headrail in the form of an open sided box structure comprising, in combination:

(a) a side wall;

(b) a top wall connected to the side wall, said top wall having a portion offset downwardly;

(c) a bottom wall connected to the side wall;

(d) a front wall having rearwardly extending top and bottom flanges running over substantially the complete width thereof, said top flange in a closed position of bracket extending over said portion of said top wall whereby the upper surface of said top flange can be accommodated on or below the upper surface of the remainder of said top wall, and said bottom flange in said closed position of bracket extending below said bottom wall;

(e) a vertical pivotal connection between the top and bottom flanges and the top and bottom walls, respectively, said pivotal connection being adjacent said side wall;

(f) latch means on at least one of said top and bottom walls and said top and bottom flanges, respectively, said latch means being spaced from said side wall, effective to prevent pivoting of said front wall away from the closed position of bracket.

7. A support bracket for a venetian blind headrail in the form of a box structure comprising, in combination:

(a) a top wall;

(b) a bottom wall;

(c) means for maintaining said top and bottom walls in spaced substantially parallel relationship;

(d) a front wall having rearwardly extending top and bottom flanges running over substantially the complete width thereof;

(e) first and second vertical pivotal connections between each said flange and wall;

(f) said first and second vertical pivotal connections aligned along a vertical axis for pivoting of said front wall between an engaged position at which said flanges and walls are juxtaposed and a disengaged position;

(g) first latch means on at least one of said top and bottom walls;

(h) second latch means on at least one of said top and bottom flanges to cooperate with said first latch means thereby to prevent inadvertent pivoting of said front wall way from its engaged position on the bracket; and, (i) said vertical axis being adjacent a vertical edge of said front wall, said means for maintaining said top and bottom walls in substantially spaced parallel relationship including a side wall having an edge adjacent the vertical edge of said front wall, and the vertical edge of said front wall in the closed and latched position of said front wall overlying the adjacent vertical edge of said side wall, whereby pivoting of said front wall relative to said bracket is positively prevented.

* * * * *